US008766072B2

(12) United States Patent
Ku

(10) Patent No.: US 8,766,072 B2
(45) Date of Patent: Jul. 1, 2014

(54) REED FOR A SAXOPHONE

(76) Inventor: Kyong Hwan Ku, Gwangyang-si (KR)

( * ) Notice: Subject to any disclaimer, the term of this patent is extended or adjusted under 35 U.S.C. 154(b) by 67 days.

(21) Appl. No.: 13/417,679

(22) Filed: Mar. 12, 2012

(65) Prior Publication Data

US 2012/0227566 A1 Sep. 13, 2012

(30) Foreign Application Priority Data

Mar. 10, 2011 (KR) ..... 10-2011-0021282

(51) Int. Cl.
*G10D 9/02* (2006.01)

(52) U.S. Cl.
USPC ..... 84/383 A; 84/383 R

(58) Field of Classification Search
CPC ..... G10D 9/023
USPC ..... 84/383 A, 383 R
See application file for complete search history.

(56) References Cited

U.S. PATENT DOCUMENTS

| | | | | | |
|---|---|---|---|---|---|
| 1,506,364 | A * | 8/1924 | Chiron et al. | ..... | 84/383 R |
| 1,667,836 | A * | 5/1928 | Brockman, Jr. | ..... | 84/383 A |
| 2,287,529 | A * | 6/1942 | Maccaferri | ..... | 84/383 A |
| 2,296,737 | A * | 9/1942 | Peterson | ..... | 84/383 A |
| 2,318,515 | A * | 5/1943 | Nemcek, Jr. | ..... | 84/383 A |
| 2,669,897 | A * | 2/1954 | Topor | ..... | 84/380 R |
| 3,267,791 | A * | 8/1966 | Roberts | ..... | 84/383 A |
| 3,420,132 | A * | 1/1969 | Backus | ..... | 84/383 A |
| 4,337,683 | A * | 7/1982 | Backus | ..... | 84/383 A |
| 5,018,425 | A * | 5/1991 | Rovner | ..... | 84/383 R |
| 5,476,026 | A * | 12/1995 | McFarlin | ..... | 84/383 R |
| 6,501,010 | B2 * | 12/2002 | Sullivan | ..... | 84/383 R |
| 6,747,198 | B1 * | 6/2004 | Sullivan | ..... | 84/383 R |
| 6,921,853 | B2 * | 7/2005 | Taillard | ..... | 84/383 A |
| 7,268,282 | B2 * | 9/2007 | Nieuwkamp | ..... | 84/383 A |
| 7,442,866 | B1 * | 10/2008 | Tsai | ..... | 84/380 R |
| 7,635,287 | B2 * | 12/2009 | May | ..... | 446/207 |
| 7,638,700 | B1 * | 12/2009 | Heintz | ..... | 84/398 |
| 7,655,852 | B2 * | 2/2010 | Sullivan | ..... | 84/383 R |
| 7,902,443 | B2 * | 3/2011 | Legere et al. | ..... | 84/363 |
| 2005/0061137 | A1 * | 3/2005 | Rovner | ..... | 84/383 A |
| 2012/0227566 | A1 * | 9/2012 | Ku | ..... | 84/383 A |

FOREIGN PATENT DOCUMENTS

| | | | |
|---|---|---|---|
| JP | 7-001677 | Y2 | 1/1995 |
| KR | 20-0134973 | Y1 | 3/1999 |
| KR | 20-0456255 | Y1 | 10/2011 |
| WO | WO0205260 | A1 | 1/2002 |

* cited by examiner

*Primary Examiner* — Robert W Horn
(74) *Attorney, Agent, or Firm* — AKC Patents LLC; Aliki K. Collins

(57) ABSTRACT

The reed for a saxophone according to an embodiment of the present invention is characterized in that one to six concave grooves are formed from a file mark 150 to a heel portion 120 in a longitudinal direction of the reed body 101 in a straight line, thus generating various tones with the aid of one to six concave grooves. In addition, an embodiment of the present invention makes it possible to generate deep and abundant tones with the aid of the increased vibrations of the reed, so the tones of a tenor saxophone can be expressed with an alto saxophone, which leads to a wide range of saxophone reed applications.

2 Claims, 3 Drawing Sheets

REED FOR A SAXOPHONE

RELATED APPLICATIONS

This application claims the benefit of Korean Patent Application No. 10-2011-0021282, filed Mar. 10, 2011 in the Korean Intellectual Property Office, which is incorporated herein by reference in its entirety.

TECHNICAL FIELD

An embodiment of the present invention relates to a reed for a saxophone, and in particular to the reed for a saxophone which makes it possible to generate the tones of an alto saxophone with a soprano saxophone and the tones of a tenor saxophone with an alto saxophone in such a way to make deep and abundant tones with the aid of the increased vibrations of the reed.

BACKGROUND ART

A reed looks like a small, thin piece and is generally made of a plant reed, a metal or a plastic. A reed is used for a woodwind musical instrument, while functioning as a sound source of the musical instrument as the reed vibrates depending on the flow of air.

A reed for a saxophone is generally made from a plant reed, a metal or a plastic. One sheet reed is engaged to a mouth piece and is tightened with a ligature.

A saxophone is designed to generate sounds as a player bites a mouth piece and blows out air in order to vibrate a reed, thus generating unique musical sounds.

As shown in FIG. 1, a conventional saxophone reed does not have any means at a reed body for generating different tones, so it is impossible for a player to generate a specific tone, and disadvantageously the tones of a tenor saxophone can not be expressed with an alto saxophone.

SUMMARY

Accordingly, it is an aspect of the present invention to provide the reed for a saxophone which makes it possible to generate deep and abundant tones by increasing the levels of the vibrations of the reed in such a way to form one to six concave grooves from a file mark to a heel portion.

In accordance with an embodiment of the present invention, a reed for a saxophone may be provided. The reed may comprise one to six concave grooves which are formed from a file mark to a heel portion in a longitudinal direction of a reed body in a straight line.

An embodiment of the present invention makes it possible to generate various tones along with abundant and deep-echoed sound with the aid of one to six concave grooves formed from a file mark to a heel portion.

An embodiment of the present invention is basically directed to expressing the tones of an alto saxophone with a soprano saxophone with the deep and abundant tones by increasing the vibrations of the reed and also to expressing the tones of a tenor saxophone with an alto saxophone, thus being well applied to various applications.

BRIEF DESCRIPTION OF THE DRAWINGS

Embodiments of the present invention will become better understood with reference to the accompanying drawings which are given only by way of illustration and thus are not limitative of the present invention, wherein.

DETAILED DESCRIPTION

Figure 1:
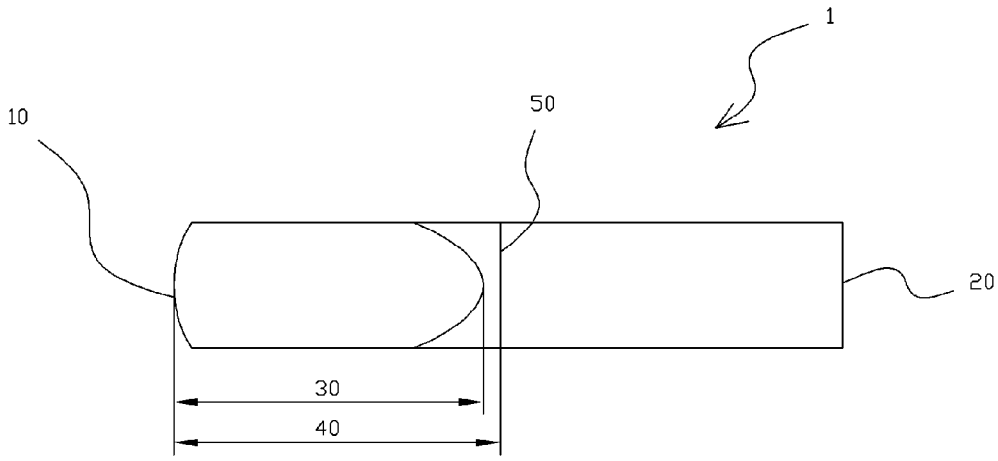
FIG. 1 is a plane view illustrating a conventional reed for a saxophone.

The reed for a saxophone according to an embodiment of the present invention will be described with reference to the accompanying drawings, wherein like reference numerals refer to the like elements throughout. The exemplary embodiments are described below to explain the present invention by referring to the figures As used in the description of this application, the terms "a", "an" and "the" may refer to one or more than one of an element (e.g., item or act). Similarly, a particular quantity of an element may be described or shown while the actual quantity of the element may differ. The terms "and" and "or" may be used in the conjunctive or disjunctive sense and will generally be understood to be equivalent to "and/or". References to "an" or "one" embodiment are not necessarily all referring to the same embodiment. Elements from an embodiment may be combined with elements of another. No element used in the description of this application should be construed as critical or essential to the invention unless explicitly described as such. Further, when an element is described as "connected," "coupled," or otherwise linked to another element, it may be directly linked to the other element, or intervening elements may be present.

Figure 2:
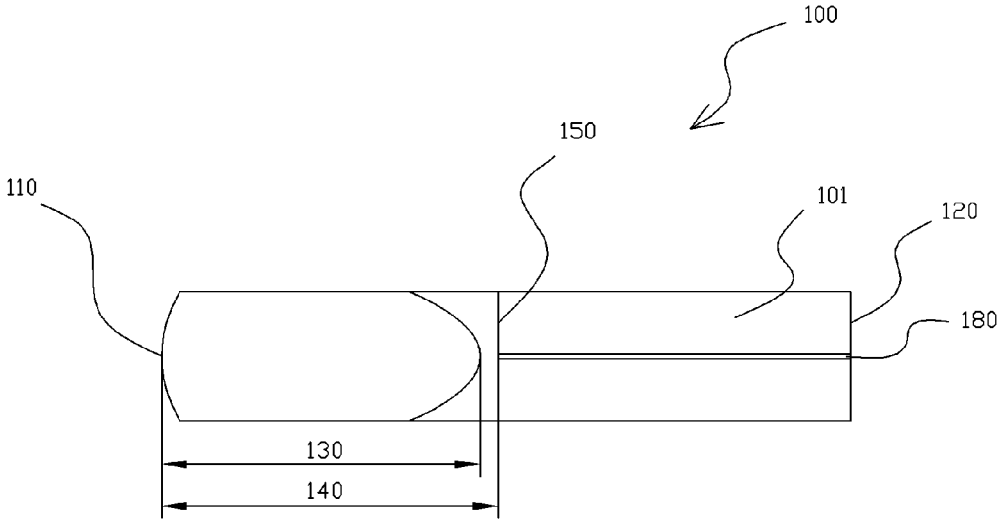
FIG. 2 is a plane view illustrating the reed for a saxophone according to an embodiment of the present invention.
Figure 3:
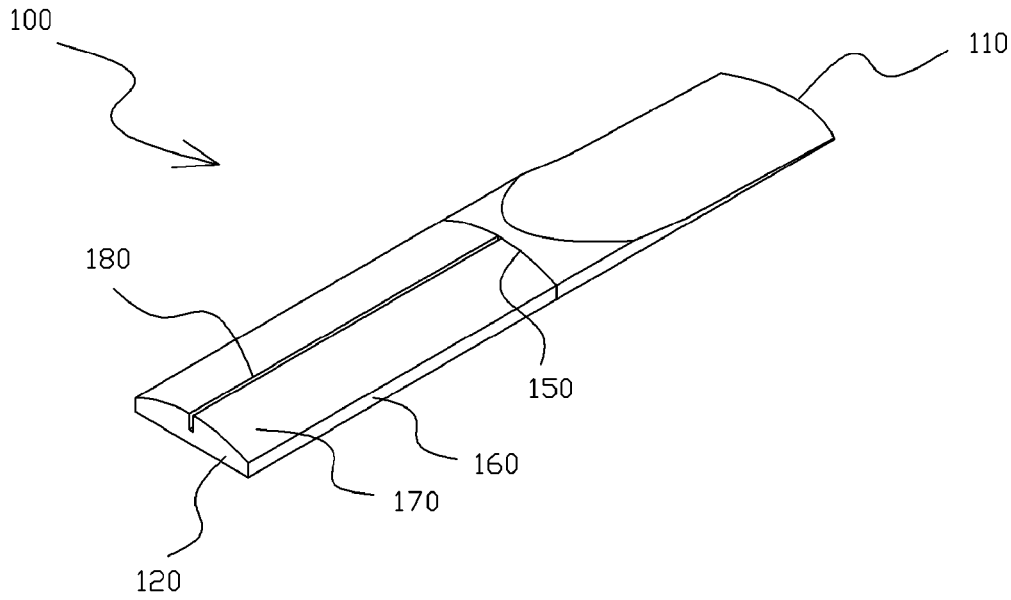
FIG. 3 is a perspective view of FIG. 2.
Figure 4:
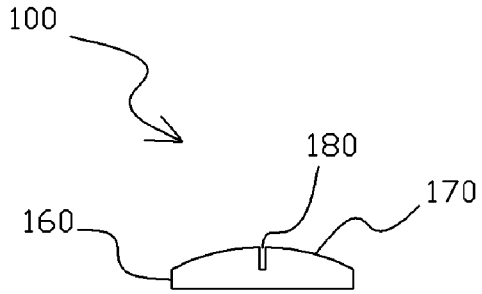
FIG. 4 is a vertical cross sectional view of FIG. 2.
Figure 5:
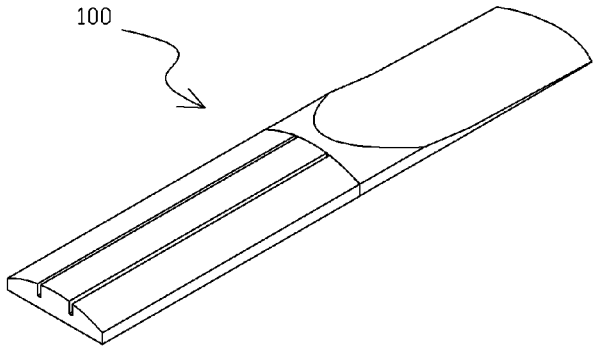
FIGS. 5 to 7 are perspective views illustrating the reed for a saxophone according to alternative embodiments of the present invention.
Figure 6:
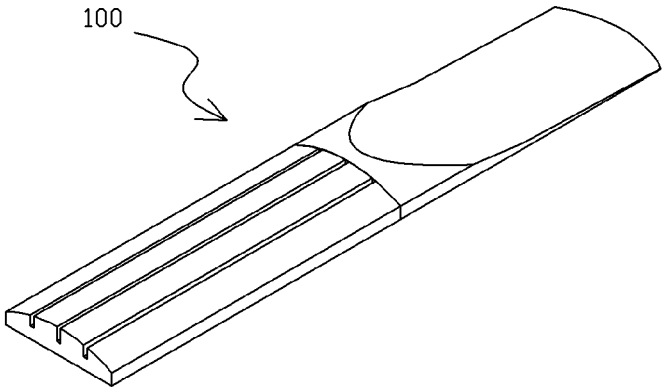
Figure 7:
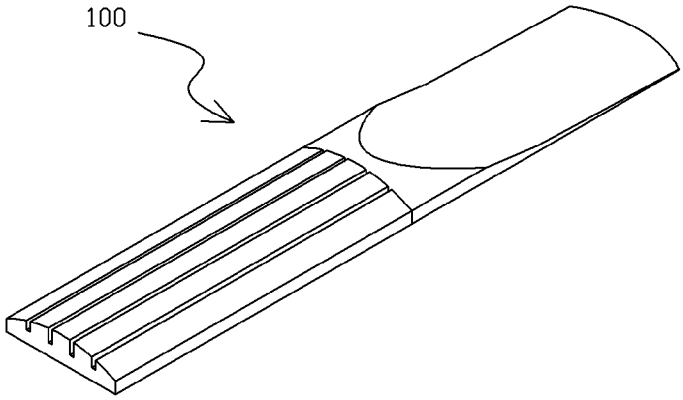

FIG. 1 is a plane view illustrating a conventional reed for a saxophone; FIG. 2 is a plane view illustrating the reed for a saxophone according to an embodiment of the present invention; FIG. 3 is a perspective view of FIG. 2; FIG. 4 is a vertical cross sectional view of FIG. 2; and FIGS. 5 to 7 are perspective views illustrating the reed for a saxophone according to alternative embodiments of the present invention.

As shown in FIGS. 1 to 7, the reed 100 for a saxophone according to an embodiment of the present invention is characterized in that one to six concave grooves 180 may be formed from a file mark 150 to a heel portion 120, thus generating deep and abundant tones with the aid of the increased vibrations of the reed 100.

At this time, the concave grooves 180 may be formed in a longitudinal direction of the reed body 101 in a straight line, and in the event that one concave groove is formed, it may be formed at the center equally dividing the width of the reed body 101, and in the event that two are formed, each of the concave grooves may be formed at the center of each of three parts formed by equally dividing the width of the reed body 101, and in the event that three concave grooves are formed, each of the concave grooves may be formed at the center of each of four parts, and in the event that four concave grooves are formed, each of the concave grooves may be formed at the center of each of five parts obtained by equally dividing the width of the same.

More concave grooves 180 can be formed in the above way. Since the width of the reed body 101 is limited, at least six concave grooves are maximum.

It is preferred that the depth of the concave groove 180 extends from the surface of the curved surface 170 downward to a plane extending between top points of vertical side surfaces 160 of the reed body 101, and the width of the concave groove 180 is preferably 0.5~3 mm. Here, the width of the same is not limited thereto. The width can be adjusted depending on the tone that the player wants to generate.

Although embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A reed for a saxophone, comprising:

one to six concave grooves which are formed from a file mark to a heel portion in a longitudinal direction of a reed body in a straight line, wherein a depth of each of the one to six concave grooves extends from a surface of a curved surface downward to a plane extending between top points of vertical side surfaces of a reed body.

2. The reed for a saxophone according to claim 1, wherein said one to six concave groves is formed in a longitudinal direction of the reed body in a straight line, and if one concave groove is formed, it is formed at a center equally dividing a width of the reed body, and if two are formed, each of the concave grooves is formed at a center of each of three parts formed by equally dividing the width of the reed body, and if three concave grooves are formed, each of the concave grooves is formed at a center of each of four parts, and if four concave grooves are formed, each of the concave grooves is formed at a center of each of five parts obtained by equally dividing the width of the same.

* * * * *